US009420377B2

(12) United States Patent
Bai et al.

(10) Patent No.: US 9,420,377 B2
(45) Date of Patent: Aug. 16, 2016

(54) AUDIO PLAYBACK DEVICE

(71) Applicant: HTC Corporation, Taoyuan County (TW)

(72) Inventors: Ming-Sian Bai, Hsinchu (TW); Bo-Cheng You, Hsinchu (TW); Yi-Yang Lo, Hsinchu (TW); Yu-Ming Chang, Hsinchu (TW); Tang-Yao Jheng, Hsinchu (TW)

(73) Assignee: HTC Corporation, Taoyuan (TW)

( * ) Notice: Subject to any disclaimer, the term of this patent is extended or adjusted under 35 U.S.C. 154(b) by 302 days.

(21) Appl. No.: 14/066,702

(22) Filed: Oct. 30, 2013

(65) Prior Publication Data

US 2015/0117697 A1 Apr. 30, 2015

(51) Int. Cl.
*H04R 9/04* (2006.01)
*H04R 11/02* (2006.01)

(52) U.S. Cl.
CPC ..... *H04R 9/04* (2013.01); *H04R 11/02* (2013.01); *H04R 2499/11* (2013.01)

(58) Field of Classification Search
CPC ..... H04R 9/04; H04R 11/02
USPC ..... 381/398, 190, 312
See application file for complete search history.

(56) References Cited

U.S. PATENT DOCUMENTS

| | | | | |
|---|---|---|---|---|
| 7,164,776 | B2 | 1/2007 | Miller et al. | |
| 8,385,583 | B2 | 2/2013 | Thompson | |
| 2010/0054509 | A1* | 3/2010 | Thompson | H04R 11/02 381/312 |
| 2011/0311090 | A1* | 12/2011 | Nagumo | H04R 11/02 381/398 |

* cited by examiner

*Primary Examiner* — Duc Nguyen
*Assistant Examiner* — Phan Le
(74) *Attorney, Agent, or Firm* — CKC & Partners Co., Ltd.

(57) ABSTRACT

An audio playback device is provided. The audio playback device includes a magnetic module, an annular armature, a coil module and a diaphragm. The magnetic module includes a magnetic source and two yokes each connected to one of two magnetic poles generated by the magnetic source and extends to form a magnetic field. The annular armature includes a first, a second, a third and a fourth arms that form a hollow area. At least part of the first arm is located in the magnetic area. The coil module is winded on the second arm and generates two varying electro-magnetic poles according to an alternating current data signal. The annular armature vibrates according to a relation of the two varying electro-magnetic poles and the magnetic field. The diaphragm is connected to the annular armature through a driving rod to vibrate according to the annular armature to generate a sound wave.

14 Claims, 5 Drawing Sheets

AUDIO PLAYBACK DEVICE

BACKGROUND

1. Field of Invention

The present invention relates to audio playback technology. More particularly, the present invention relates to an audio playback device.

2. Description of Related Art

Handheld electronic devices such as smartphones and tablet PCs become the most popular electronic products due to their light weight. Besides basic telephone communication ability, the handheld electronic devices are further equipped with wireless network communication ability to access information and perform communication conveniently.

Recently, the requirement of displaying multimedia files and games becomes higher. Audio playback device with good quality becomes a basic requirement of the handheld electronic devices. However, since the size of the handheld electronic devices is small, it is a great challenge to shrink the volume of the audio playback device without affecting its performance.

Accordingly, what is needed is an audio playback device to address the above issues.

SUMMARY

An aspect of the present invention is to provide an audio playback device. The audio playback device includes a magnetic module, an annular armature, a coil module and a diaphragm. The magnetic module includes a magnetic source and two yokes, wherein each of the two yokes is connected to one of two magnetic poles generated by the magnetic source, and the two yokes extend substantially in parallel to form a magnetic field therebetween. The annular armature includes a first arm, a second arm, a third arm and a fourth arm that form a hollow area, wherein the third arm and the fourth arm respectively connect the first arm to the second arm and at least part of the first arm is located in the magnetic field. The at least one coil module is wound on the second arm and generates two varying electro-magnetic poles corresponding to the third arm and the fourth arm respectively according to an alternating current signal, such that the annular armature vibrates according to a magnetic relation of the two varying electro-magnetic poles and the magnetic field. The diaphragm is connected to the annular armature through a driving rod to vibrate according to a vibration of the annular armature to generate a sound wave.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
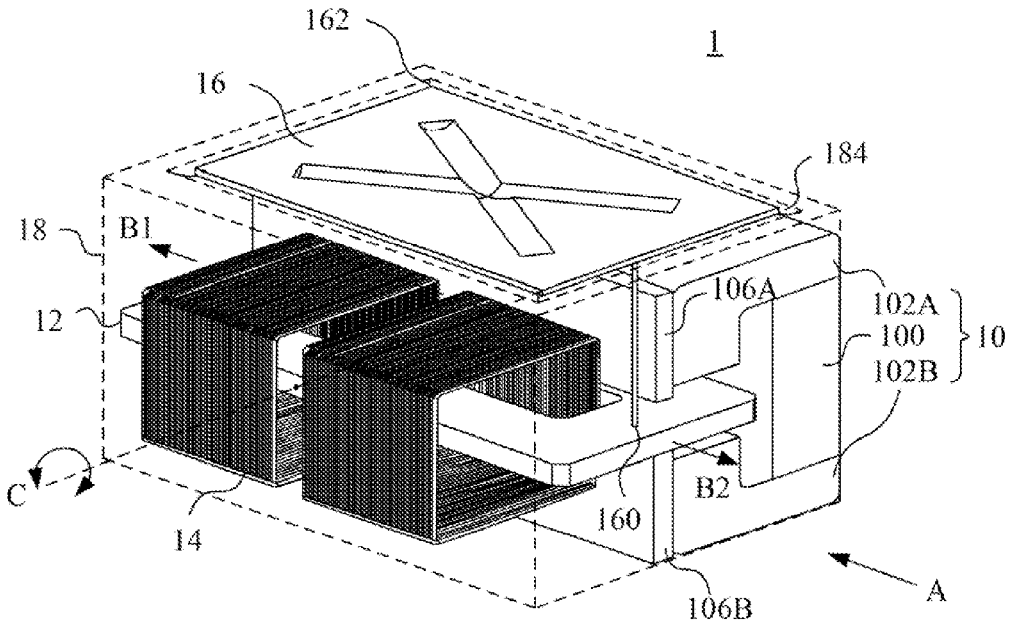
FIG. 1 is a 3 dimensional (3-D) perspective diagram of an audio playback device in an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a 3 dimensional (3-D) perspective diagram of an audio playback device 1 in an embodiment of the present invention. The audio playback device 1 includes a magnetic module 10, an annular armature 12, coil modules 14, a diaphragm 16 and a case 18. The case 18 contains the magnetic module 10, the annular armature 12 and the coil modules 14. In order to clearly depict and introduce the elements contained in the case 18, the case 18 is illustrated by dash lines.

Figure 2:
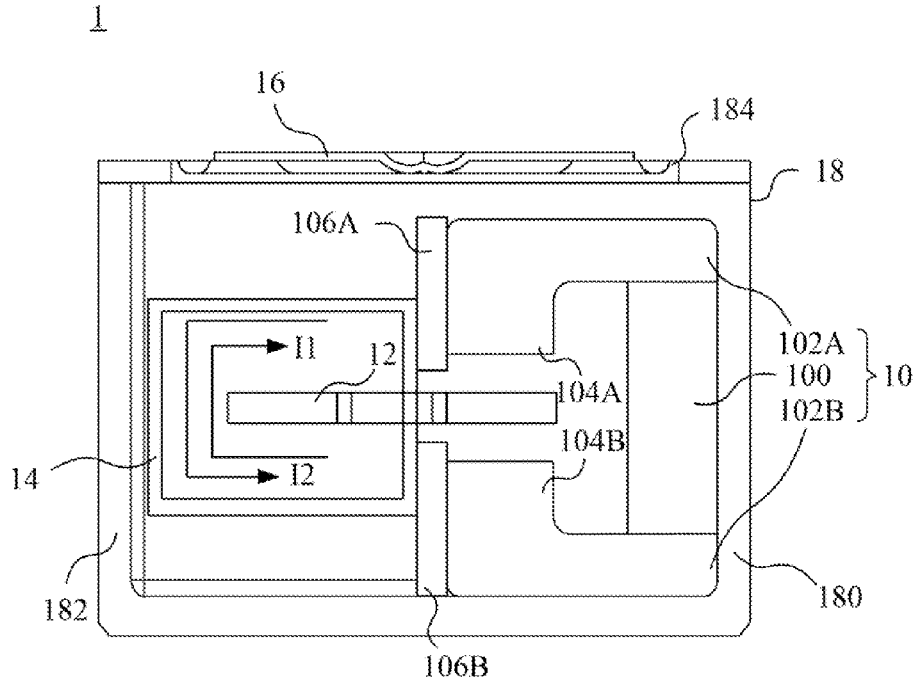
FIG. 2 is a sectional side view of the audio playback device observed from direction A in FIG. 1 in an embodiment of the present invention.

The magnetic module 10 is discussed by using FIG. 1 together with FIG. 2. FIG. 2 is a sectional side view of the audio playback device 1 observed from direction A in FIG. 1 in an embodiment of the present invention.

As illustrated in FIG. 1 and FIG. 2, the magnetic module 10 includes a magnetic source 100 and two yokes 102A and 102B. In an embodiment, the magnetic source 100 is a permanent magnet to generate two magnetic poles including a north pole (N-pole) and a south pole (S-pole). In other embodiments, the magnetic source 100 can be other material or electro-magnetic equipment that is able to generate two steady magnetic poles. In the present embodiment, the magnetic source 100 is fixed to a sidewall 180 of the case 18 as illustrated in FIG. 2.

Each of the two yokes 102A and 102B is connected to one of the two magnetic poles of the magnetic source 100. For example, the yoke 102A is connected to the north pole and the yoke 102B is connected to the south pole. In another embodiment, the yoke 102A can be connected to the south pole and the yoke 102B can be connected to the north pole.

In an embodiment, the magnetic source 100 and the yokes 102A and 102B can be implemented by a single horseshoe magnet. In another embodiment, the yokes may include magnetic-conducting material different from the material included in the magnetic source 100. The magnetic-conducting material can be such as, but not limited to nickel, iron, cobalt, Gadolinium and an alloy or composite of at least one of the above.

The two yokes 102A and 102B extend substantially in parallel to extend the lines of the magnetic field of the two magnetic poles generated by the magnetic source 100 due to their magnetic-conducting ability. It is noted that the term 'substantially' means that the two yokes 102A and 102B are not necessarily to be completely in parallel to each other and a tolerable error may be presented. In an embodiment, the yoke 102A includes a protrusion part 104A and the yoke 102B includes a protrusion part 104B. The protrusion part 104A and the protrusion part 104B further guide the lines of the magnetic field toward the space between the two yokes 102A and 102B. A magnetic field is formed therebetween.

Figure 3:
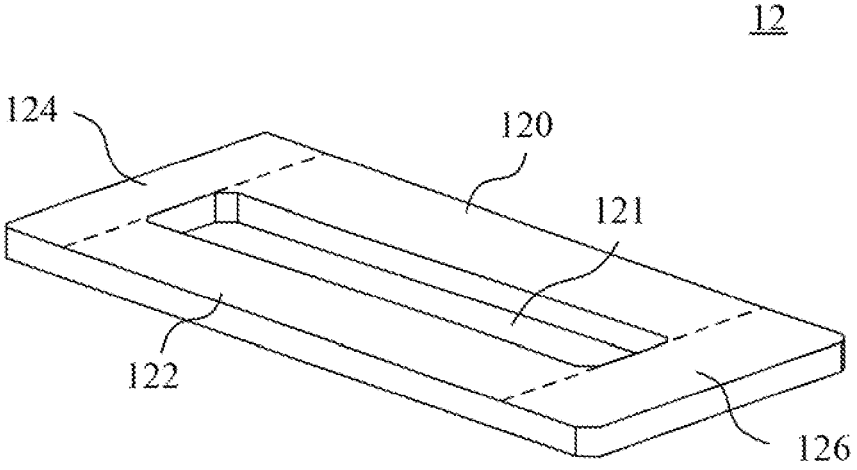
FIG. 3 is a 3-D diagram of the annular armature in an embodiment of the present invention.

The annular armature 12 is discussed by using FIG. 1 together with FIG. 3. FIG. 3 is a 3-D diagram of the annular armature 12 in an embodiment of the present invention.

The annular armature 12 includes a first arm 120, a second arm 122, a third arm 124 and a fourth arm 126. A hollow area 121 is formed, in which the hollow area 121 is surrounded by the first arm 120, the second arm 122, the third arm 124 and the fourth arm 126. The third arm 124 and the fourth arm 126 respectively connect the first arm 120 to the second arm 122. In different embodiments, the first arm 120, the second arm 122, the third arm 124 and the fourth arm 126 are either once-formed or are formed separately and connected to each other subsequently. The first arm 120, the second arm 122, the third arm 124 and the fourth arm 126 form a close loop without any gap formed thereon. For example, the first arm 120, the second arm 122 and the third arm 124 can be once-formed and be further connected to the independently formed fourth arm 126 to form the close loop.

In different embodiments, the shape of the annular armature 12 is such as, but not limited to a square shape as illustrated in FIG. 1, a circular shape or any other symmetrical shapes. In different embodiment, the material of the annular armature 12 is such as, but not limited to silicon steel or other materials that can be magnetized.

In the present embodiment, at least part of the first arm 120 is located in the magnetic field formed between the yokes 102A and 102B illustrated in FIG. 1.

The coil modules 14 are discussed by using FIG. 1 together with FIG. 2 and FIG. 3. The coil modules 14 are wound on the annular armature 12. In the present embodiment, the coil modules 14 are wound on the second arm 122. In an embodiment, in order not to affect the operation of the annular armature 12, the coil modules 14 do not contact the annular armature 12. In the present embodiment, the coil modules 14 are fixed to the sidewall 182 of the case 18 as illustrated in FIG. 2, in which the sidewall 182 is opposite to the sidewall 180. In other embodiments, the coil modules 14 can be fixed by other methods such that the coil modules 14 do not contact the annular armature 12. In an embodiment, the coil modules 14 are formed by being wound on the second arm 122 of the once-formed annular armature 12. In another embodiment, the coil modules 14 are formed first and the arms of the annular armature 12 are separately formed later. It is noted that the number of the coil modules 14 is not limited to two, as illustrated in FIG. 2. The number of the coil modules 14 can be adjusted according to the practical conditions.

The coil modules 14 generate two varying electro-magnetic poles corresponding to the third arm 124 and the fourth arm 126 respectively according to an alternating current signal. For example, when the alternating current in the coil modules 14 flows in direction I1 (clockwise) illustrated in FIG. 2, the direction of the magnetic field formed according to the alternating current is the direction B1 as illustrated in FIG. 1, according to Ampere's right hand rule. The north pole is generated at the location corresponding to the third arm 12 and the south pole is generated at the location corresponding to the fourth arm 126. On the contrary, when the alternating current in the coil modules 14 flows in direction I2 (counter-clockwise) illustrated in FIG. 2, the direction of the magnetic field formed according to the alternating current is the direction B2 as illustrated in FIG. 1, according to Ampere's right hand rule. The south pole is generated at the location corresponding to the third arm 12 and the north pole is generated at the location corresponding to the fourth arm 126.

It is noted that, under the condition mentioned above, the magnetic field gradually switches from the one end of the first arm 120 connected to the third arm 124 and corresponding to one polarity to the other end of the first arm 120 connected to the fourth arm 126 and corresponding to the other polarity. Similarly, the magnetic field gradually switches from the one end of the second arm 122 connected to the third arm 124 and corresponding to one polarity to the other end of the second arm 122 connected to the fourth arm 126 and corresponding to the other polarity.

The two electro-magnetic poles generated on the third arm 124 and the fourth arm 126 by the coil modules 14 keep switching due to the variation of the alternating current signal. The magnetic relation between the first arm 120 and the magnetic field therefore keeps varying as well.

For example, the magnetic field is generated by the conducing arm 102A with the north pole and the yoke 102B with the south pole. When the north pole is generated on the third arm 124 and the south pole is generated on the fourth arm 126 according to the alternating current signal of the coil modules 14, the end of the first arm 120 connected to the fourth arm 126 is attracted by the yoke 102A and is rejected by the yoke 102B. Hence, the end of the first arm 120 connected to the fourth arm 126 tends to rise. The end of the first arm 120 connected to the third arm 124 is rejected by the yoke 102A and is attracted by the yoke 102B. Hence, the end of the first arm 120 connected to the third arm 124 tends to fall.

On the contrary, when the north pole is generated on the fourth arm 126 and the south pole is generated on the third arm 124 according to the alternating current signal of the coil modules 14, the end of the first arm 120 connected to the fourth arm 126 tends to fall, and the end of the first arm 120 connected to the third arm 124 tends to rise.

Due to the quick-varying alternating current signal, the annular armature 12 keeps vibrating. In an embodiment, when the magnetic forces applied to the annular armature 12 are symmetry, the annular armature 12 vibrates around an axis C extending from the central area of the first arm 120 to the central area of the second arm 122.

The diaphragm 16 is connected to the annular armature 12 through a driving rod 160. In the present embodiment, the diaphragm 16 is disposed corresponding to the opening 184 of the case 18 and is suspended at an edge of the opening 184. The diaphragm 16 can be suspended at the edge of the opening by using such as, but not limited to an elastic connection means 162. It is noted that the shape of each of the diaphragm 16 and the corresponding opening 184 are not necessarily to be a square shape and can be adjusted in other embodiments according to the practical conditions.

When the annular armature 12 vibrates according to the alternating current signal in the coil modules 14, the diaphragm 16 vibrates according to the vibration of the annular armature 12 to generate a sound wave. In the present embodiment, as illustrated in FIG. 1, the diaphragm 16 is connected to the fourth arm 126 of the annular armature 12 through the driving rod 160 such that the diaphragm 16 is able to vibrate to accomplish larger amplitude. In other embodiments, the driving rod 160 is not necessarily to be disposed on the location illustrated in FIG. 1 and can be disposed in other locations of the annular armature 12 where the driving rod 160 can vibrate accordingly.

It is noted that in order to prevent the vibrating annular armature 12 crashes to the yokes 102A and 102B, the audio playback device 1 may selectively include crash-proof pads 106A and 106B disposed on the yokes 102A and 102B as illustrated in FIG. 1. In other embodiments, the crash-proof pads 106A and 106B can be disposed on the front end of the protrusion parts 104A and 104B. In an embodiment, the crash-proof pads 106A and 106B includes a soft or elastic material. Moreover, the distance between the two crash-proof pads 106A and 106B and the annular armature 12 is smaller than that between the two yokes 102A and 102B and the annular armature 12. As a result, the crash-proof pads 106A and 106B provide the protection mechanism when the annular armature 12 vibrates.

Consequently, the coil modules 14 generate varying electro-magnetic poles on the annular armature 12 according to the alternating current signal transmitted from such as a driving circuit (not illustrated). The annular armature 12 vibrates according to the magnetic relation of the varying electromagnetic poles and the magnetic field established by the magnetic module 10. The diaphragm 16 further vibrates according to the driving rod 160 connected to the vibrating annular armature 12. Since the magnetic resistance of the annular armature 12 is small, a high vibration efficiency is obtained according to the magnetic force even when the size of the annular armature 12 is small. Further, different sound waves are generated from the diaphragm 16 according to various amplitudes and frequencies of the alternating current signal. The audio playback mechanism can be accomplished.

Figure 4:
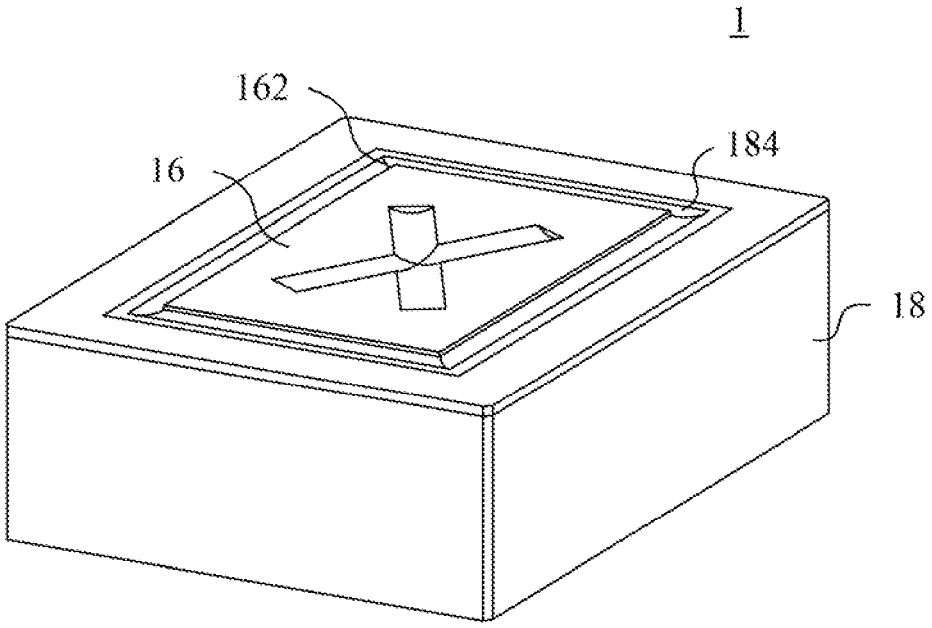
FIG. 4 is a 3-D diagram of the audio playback device in FIG. 1 in an embodiment of the present invention.

FIG. 4 is a 3-D diagram of the audio playback device 1 in FIG. 1 in an embodiment of the present invention. As illustrated in FIG. 4, the case 18 of the audio playback device 1 contains and caps the magnetic module 10, the annular armature 12 and the coil modules 14. Only the diaphragm 16 suspended by the connection means 162 at the edge of the opening 184 is exposed.

Figure 5:
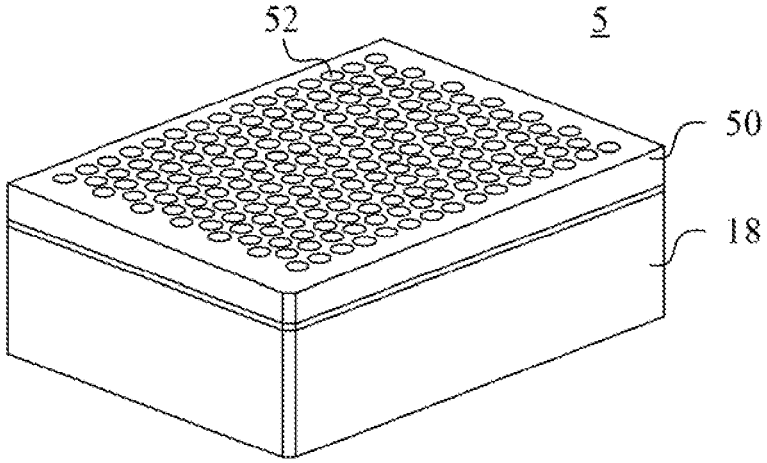
FIG. 5 is a 3-D diagram of the audio playback device in FIG. 1 in an embodiment of the present invention.

FIG. 5 is a 3-D diagram of the audio playback device 5 in FIG. 1 in an embodiment of the present invention. In the present embodiment, the audio playback device 5 includes all the components illustrated in FIG. 1 to FIG. 4. Moreover, the audio playback device 5 includes a cap 50 to cover the surface corresponding to the opening 184 (not illustrated in FIG. 5) to provide a protection mechanism. In the present embodiment, in order not to block the sound wave generated by the components disposed inside, the cap 50 includes sound holes 52 formed thereon such that the sound wave can be transmitted outside of the audio playback device 5 through the sound holes 52.

Figure 6:
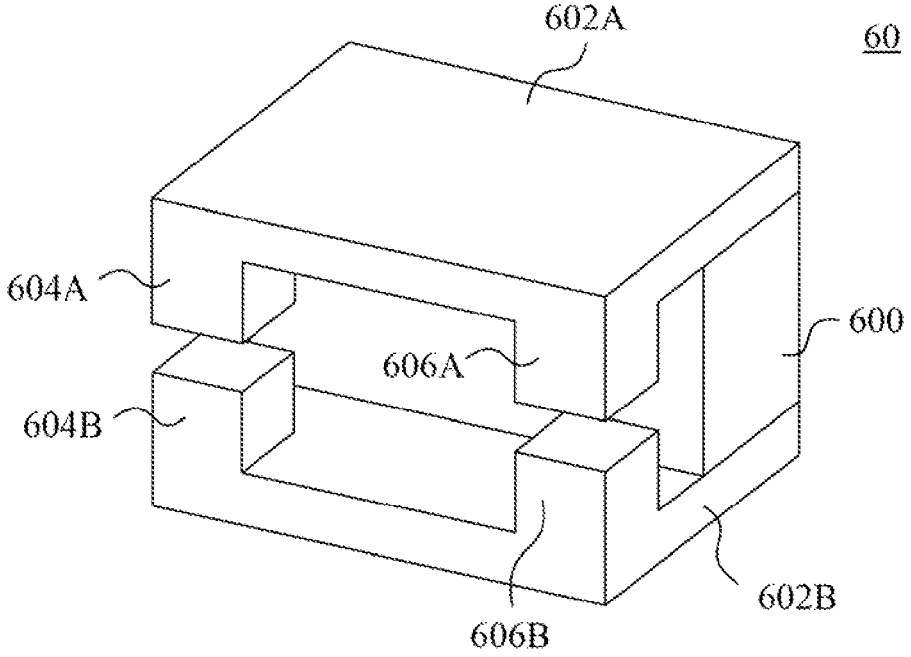
FIG. 6 is a 3-D diagram of the magnetic module in an embodiment of the present invention.

FIG. 6 is a 3-D diagram of the magnetic module 60 in an embodiment of the present invention. In the present embodiment, the magnetic module 60 includes a magnetic source 600 and two yokes 602A and 602B. The magnetic source 600 is the same as the magnetic source 100 illustrated in FIG. 2 and generates two magnetic poles.

Each of the yokes 602A and 602B is corresponding to one of the two magnetic poles to extend the lines of the magnetic field from the magnetic source 600. In the present embodiment, the yoke 602A includes two protrusion parts 604A and 606A. The yoke 602B includes two protrusion parts 604B and 606B. The protrusion parts 604A and 604B are opposite to each other and the protrusion parts 606A and 606B are opposite to each other. The protrusion parts 604A, 604B, 606A and 606B guide the lines of the magnetic field more concentratedly to the space between the yokes 602A and 602B to form a stronger magnetic field.

Figure 7:
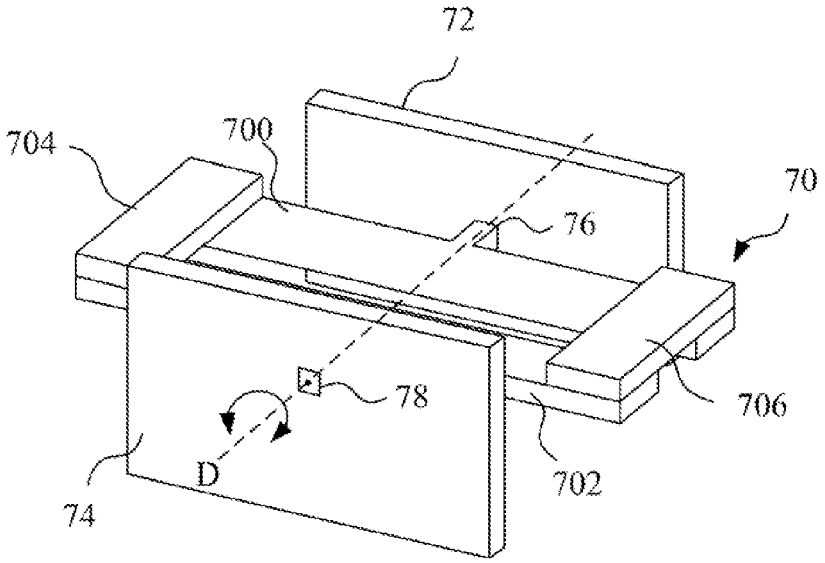
FIG. 7 is a 3-D diagram of an annular armature, a first fixed wall and a second fixed wall in an embodiment of the present invention.

FIG. 7 is a 3-D diagram of an annular armature 70, a first fixed wall 72 and a second fixed wall 74 in an embodiment of the present invention. The annular armature 70 is the same as the annular armature 12 illustrated in FIG. 3 and includes a first arm 700, a second arm 702, a third arm 704 and a fourth arm 706. The first arm 700, the second arm 702, the third arm 704 and the fourth arm 706 are respectively formed and subsequently connected to form a close loop.

In the present embodiment, the first arm 700 and the second arm 702 include a first protrusion part 76 and a second protrusion part 78 respectively. The first protrusion part 76 and the second protrusion part 78 extend to be vertically embedded to the first fixed wall 72 and the second fixed wall 74 respectively. In an embodiment, the first protrusion part 76 is formed on a central area of the first arm 700. The second protrusion part 78 is formed on a central area of the second arm 702. As a result, when the annular armature 70 vibrates according to the magnetic force as described in the previous embodiments, the annular armature 70 vibrates around the axis D formed between the first protrusion part 76 and the second protrusion part 78.

The first fixed wall 72 and the second fixed wall 74 are discussed in detail in the subsequent embodiment.

Figure 8:
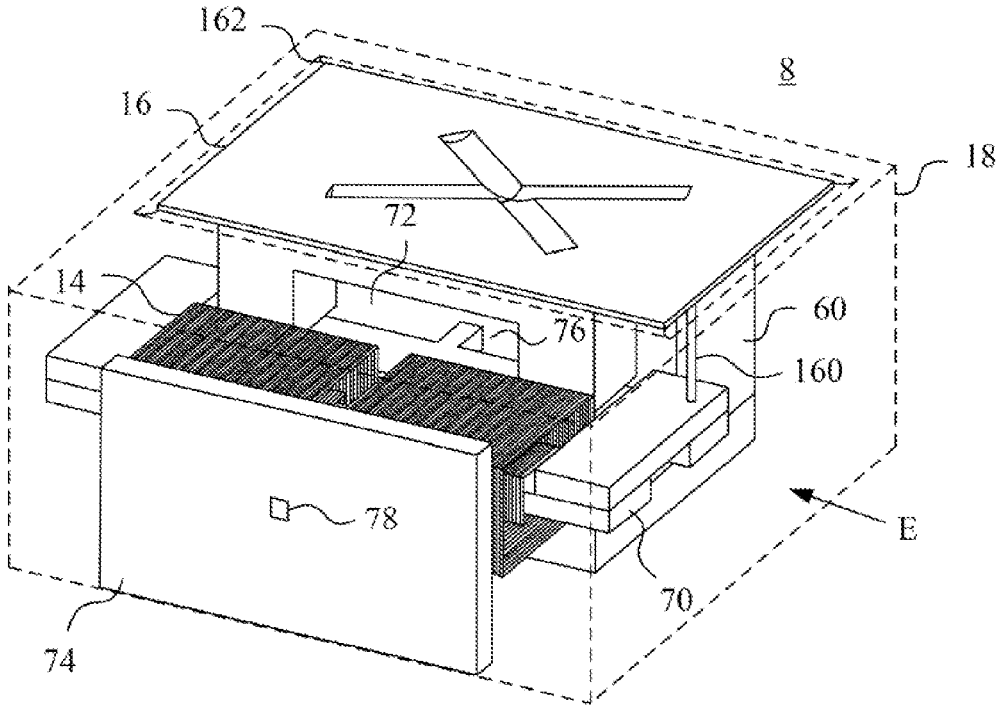
FIG. 8 is a 3-D perspective view of an audio playback device in an embodiment of the present invention.
Figure 9:
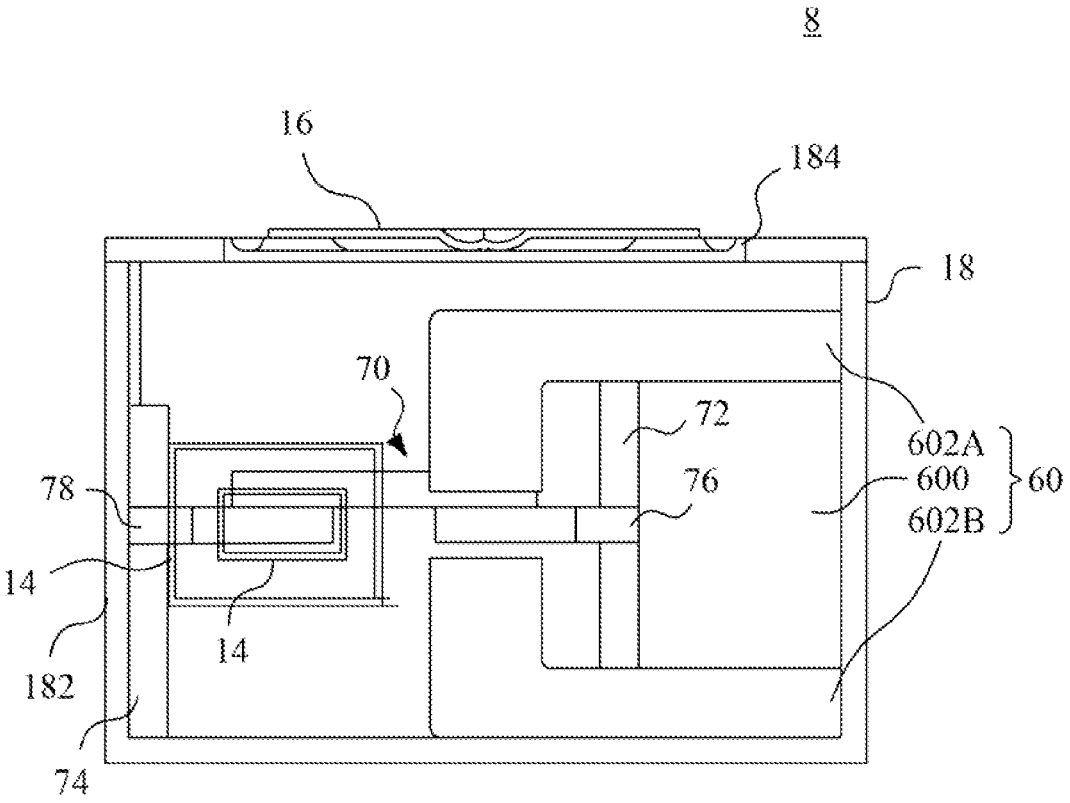
FIG. 9 is a cross-sectional side view of the audio playback device observed from direction E in FIG. 8 in an embodiment of the present invention.

FIG. 8 is a 3-D perspective view of an audio playback device 8 in an embodiment of the present invention. FIG. 9 is a cross-sectional side view of the audio playback device 8 observed from direction E in FIG. 8 in an embodiment of the present invention.

The audio playback device 8 includes similar components as those of the audio playback device 1 illustrated in FIG. 1 and FIG. 2, e.g. the coil modules 14, the diaphragm 16 and the case 18. These components in FIG. 8 substantially have the same structures and functions as those illustrated in FIG. 1 and FIG. 2. Hence, no more detail is discussed herein. However, the audio playback device 8 includes the magnetic module 60 illustrated in FIG. 6 and the annular armature 70, the first fixed wall 72 and the second fixed wall 74 illustrated in FIG. 7.

In the present embodiment, the first fixed wall 72 and the second fixed wall 74 are substantially in parallel. It is noted that the term 'substantially' means that the first fixed wall 72 and the second fixed wall 74 are not necessarily to be completely in parallel to each other and a tolerable error may be presented. The first fixed wall 72 is connected to the case 18, e.g. the sidewall 182 of the case 18. In the present embodiment, the second fixed wall 74 is connected to the yokes 602A and 602B. Therefore, the first fixed wall 72 and the second fixed wall 74 provides a fixing mechanism for the annular armature 70. The vibration of the annular armature 70 generated according to the alternating current signal in the coil modules 14 can be transmitted more thoroughly to the diaphragm 16 through the driving rod 160. The loss of energy due to the unstable annular armature 70 is prevented.

It is noted that the design of the magnetic module 60, the annular armature 70, the first fixed wall 72 and the second fixed wall 74 can be applied to the embodiments illustrated in FIG. 1 and FIG. 2 as well, and is not limited to the embodiments illustrated in FIG. 7 and FIG. 8.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An audio playback device comprising:

a magnetic module comprising a magnetic source and two yokes, wherein each of the two yokes is connected to one of two magnetic poles generated by the magnetic source, and the two yokes extend substantially in parallel to form a magnetic field therebetween;

an annular armature comprising a first arm, a second arm, a third arm and a fourth arm that form a hollow area, wherein the third arm and the fourth arm are respectively connected the first arm and the second arm, and at least part of the first arm is located in the magnetic field;

at least one coil module, wound on the second arm and generating two varying electro-magnetic poles corresponding to the third arm and the fourth arm respectively according to an alternating current signal in the annular armature, such that the annular armature vibrates according to a magnetic relation of the two varying electro-magnetic poles and the magnetic field; and a diaphragm connected to the annular armature through a driving rod to vibrate according to a vibration of the annular armature so as to generate a sound wave.

2. The audio playback device of claim 1, wherein each of the two yokes comprises a protrusion part opposite to each other and extends towards a space between the two yokes so as to form the magnetic field.

3. The audio playback device of claim 1, wherein each of the two yokes comprises two protrusion parts opposite to each other, corresponding to one of the varying electro-magnetic poles respectively, and extends towards a space between the two yokes so as to form the magnetic field.

4. The audio playback device of claim 1, further comprising two crash-proof pads each formed on one of the two yokes, wherein the distance between the two crash-proof pads and the annular armature is smaller than that between the two yokes and the annular armature.

5. The audio playback device of claim 1, further comprising a case to house the magnetic module, the annular armature and the coil module, wherein the case comprises an opening such that the diaphragm is disposed corresponding to the opening and is suspended at an edge of the opening.

6. The audio playback device of claim 5, wherein the coil module is fixed to a first sidewall of the case and the magnetic source is fixed to a second sidewall of the case opposite to the first sidewall.

7. The audio playback device of claim 5, further comprises a first fixed wall and a second fixed wall that are substantially parallel to each other, wherein the first fixed wall is connected to the case and the second fixed wall is connected to the at least one of the yokes; the first arm and the second arm of the annular armature form a first protrusion part and a second protrusion part in their central region, and the first protrusion part and the second protrusion part respectively extend to be embedded to the first fixed wall and the second fixed wall.

8. The audio playback device of claim 7, wherein the annular armature vibrates around an axis formed between the first protrusion part and the second protrusion part.

9. The audio playback device of claim 7, wherein the first fixed wall is fixed to a first sidewall of the case, and the magnetic source is fixed to a second sidewall of the case opposite to the first sidewall.

10. The audio playback device of claim 5, further comprising a cap covering a surface of the case corresponding to the opening, wherein the cap comprises a plurality of sound holes.

11. The audio playback device of claim 1, wherein the annular armature is closed and has no gap formed thereon.

12. The audio playback device of claim 1, wherein the magnetic source is a permanent magnet.

13. The audio playback device of claim 1, wherein the shape of the annular armature is square or circular.

14. The audio playback device of claim 1, wherein polarities of the two varying electro-magnetic poles vary according to a variation of the alternating current signal.

* * * * *